US010934125B2

(12) United States Patent
Eaton et al.

(10) Patent No.: US 10,934,125 B2
(45) Date of Patent: Mar. 2, 2021

(54) METHOD AND SYSTEM FOR MONITORING DRAWING OF YARN FROM A BOBBIN

(71) Applicant: Saurer Fibrevision Ltd., Macclesfield (GB)

(72) Inventors: David Charles Eaton, Macclesfield (GB); Nigel Warne, Macclesfield (GB)

( * ) Notice: Subject to any disclaimer, the term of this patent is extended or adjusted under 35 U.S.C. 154(b) by 0 days.

(21) Appl. No.: 16/210,133

(22) Filed: Dec. 5, 2018

(65) Prior Publication Data

US 2019/0177108 A1 Jun. 13, 2019

(30) Foreign Application Priority Data

Dec. 8, 2017 (GB) ..... 1720479

(51) Int. Cl.

| | |
|---|---|
| ***B65H 49/16*** | (2006.01) |
| ***B65H 63/08*** | (2006.01) |
| ***B65H 67/02*** | (2006.01) |
| ***B65H 49/12*** | (2006.01) |

(52) U.S. Cl.

CPC ..... *B65H 49/16* (2013.01); *B65H 49/12* (2013.01); *B65H 63/086* (2013.01); *B65H 67/02* (2013.01); *B65H 2701/31* (2013.01)

(58) Field of Classification Search

CPC ..... B65H 49/12; B65H 49/16; B65H 63/086; B65H 2701/31

See application file for complete search history.

(56) References Cited

U.S. PATENT DOCUMENTS

| | | | | |
|---|---|---|---|---|
| 4,330,094 | A | 5/1982 | Mayer | |
| 5,201,346 | A | 4/1993 | Cox | |
| 2001/0037545 | A1* | 11/2001 | Stuttem | B65H 63/086 28/248 |

FOREIGN PATENT DOCUMENTS

| | | |
|---|---|---|
| EP | 0425118 A2 | 2/2003 |
| GB | 1283528 A | 7/1972 |

OTHER PUBLICATIONS

Great Brittan search report issued in corresponding GB Application 1283528 dated Jun. 7, 2018.

* cited by examiner

*Primary Examiner* — William E Dondero

(74) *Attorney, Agent, or Firm* — The Law Firm of Andrea Hence Evans, LLC

(57) ABSTRACT

The invention provides a method and a system for monitoring of yarn drawn axially from a bobbin (24*a*). It is desired to monitor one or both of remaining capacity of an active bobbin and transfer from one active bobbin 24*a* to the next. A free portion (30) of the yarn moves circumferentially about the bobbin as the yarn is drawn from it. The invention involves a sensor responsive to electromagnetic radiation arranged to sense the free portion (30) of the yarn and to provide an output which varies with a period P corresponding to the period of the circumferential movement of the free portion of the yarn about the bobbin (24*a*). The period P can be interpreted to provide the desired information.

11 Claims, 2 Drawing Sheets

METHOD AND SYSTEM FOR MONITORING DRAWING OF YARN FROM A BOBBIN

The invention relates to monitoring of processes in which yarn is drawn from a bobbin.

Many types of textile machinery which process yarns, either to improve the yarn properties or to fashion them into fabrics, rely on previously wound bobbins of yarn suspended so that the yarns can be unwound 'end over end', often at high speed, into the active processing parts of the machine. An example is provided by known draw texturing machines, which are familiar to the skilled person.

The word "yarn" as used herein refers to any elongate flexible fibre able to be wound on a bobbin, regardless of its purpose or material. Yarns may be natural or synthetic, and may be for use in fabric or for other purposes.

The structure which supports the bobbins, and guides the yarns to the active elements of the processing machine, is known as a creel. FIG. 1 shows an example of a creel 10 of known type, having a lightweight tubular frame structure 12 with the bobbins 14 supported on pegs 16 which are hinged so they can be swung out to allow access to the bobbins 14 for replacement. The yarn is supported on its journey from its bobbin 14 to the machine (not shown) by a series of ceramic guides and tubes mounted within the creel framework. Typically a creel 10 can accommodate hundreds of bobbins 14. The bobbins 14 can weigh 10 kg or more and mechanical assistance is often required to manoeuvre them into position on the creel 10.

The bobbins 14 do not rotate as the yarn is drawn from them. The yarn is drawn along a direction which is roughly axial with respect to the bobbin, allowing the yarn to move freely off the bobbin 14. The yarn is of course wound circumferentially about the bobbin. As it unwinds, the point of disengagement of the yarn from the bobbin moves about it circumferentially. A free portion of the yarn, between the bobbin 14 and an eyelet guide through which the yarn is drawn, whirls about the bobbin and is thrown outward somewhat due to its own weight, so that the yarn forms a rotating envelope known as a balloon.

To facilitate continuous machine operation the yarn from a reserve bobbin is spliced onto the free end of each active bobbin so that the supply of yarn to the processing section of the machine is maintained when the active bobbin is exhausted. The empty tubes of the used bobbins are removed and reserve bobbins installed and spliced onto the active bobbin as required. Typically the yarn is withdrawn from the creel 10 at a constant speed of several hundred metres/min. Depending on the processing speed of the machine and the size of the supply bobbins it can take between several hours or several days for this transfer from active bobbin to reserve bobbin to take place. Traditionally the used bobbins are replaced by manually patrolling and identifying the creel locations where a transfer from the active bobbin to the reserve has taken place.

Manual recording of the transfer details per processing location is useful for production control and especially quality control, since many processing faults result from faults which are already present in the supplied bobbins due to upstream processing errors. In certain processes the transfer splice itself may be a significant fault requiring the processed yarn to be segregated and downgraded to second quality. Manual monitoring involves labour and consequent expense, which it would be desirable to avoid through automation of the required monitoring.

Creel monitoring systems have been devised which use a pair of motion sensors, one located at the active bobbin and one at the reserve bobbin, so that the transfer from active to reserve bobbin can be logged directly into the production and quality control system of the textile plant. This necessitates the motion sensors being mounted close to their respective bobbins (active & reserve) and cables carrying power and signal to the sensors along the often moveable framework of the creel. These systems often require manual threading of the sensor when the new reserve bobbin is spliced in and inevitably human error causes failure to thread the sensor properly or at all rendering these systems unreliable. Other systems have been used which rely on micro-switches in the yarn's path, but these rely on some component making contact with the yarn and that component is subject to rapid wear and consequent failure.

An improved method and apparatus is therefore needed for monitoring of withdrawal of yarn from the bobbin.

According to the present invention there is a method of monitoring drawing of yarn from a bobbin, in which

- the yarn is drawn axially from the bobbin and a free portion of the yarn moves circumferentially about the bobbin;
- a sensor responsive to electromagnetic radiation is arranged to sense the free portion of the yarn and to provide an output which varies with a period corresponding to the period of the circumferential movement of the free portion of the yarn about the bobbin.

Reference to the yarn being drawn axially from the bobbin does not imply that the yarn's path is necessarily precisely axial, but simply that the yarn is drawn off the bobbin from one end, rather than being drawn along a radial direction in a manner that would involve rotation of the bobbin. Where reference is made to the period P, it must be understood that this implies a certain corresponding frequency f which is the reciprocal of the period, and that any estimate or calculation based upon or involving the period P thus also involves the corresponding frequency f. References to determination of the period P or to uses of the period P must be understood to include reference to use or determination of the corresponding frequency f.

Specific embodiments of the present invention will now be described, by way of example only, with reference to the accompanying drawings, in which.

Figure 1:
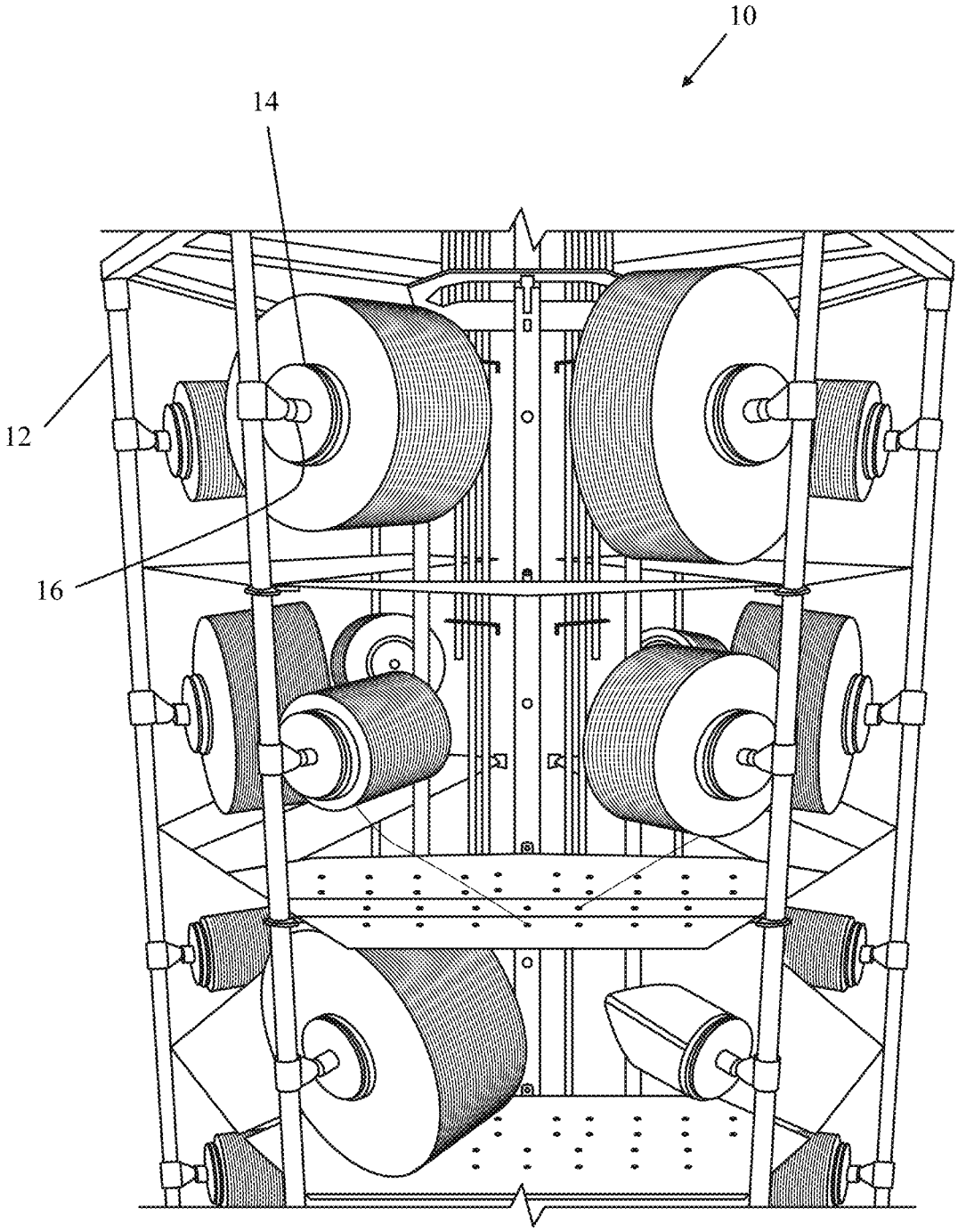
FIG. 1 is a view of a creel belonging to the prior art, from one side.
Figure 2:
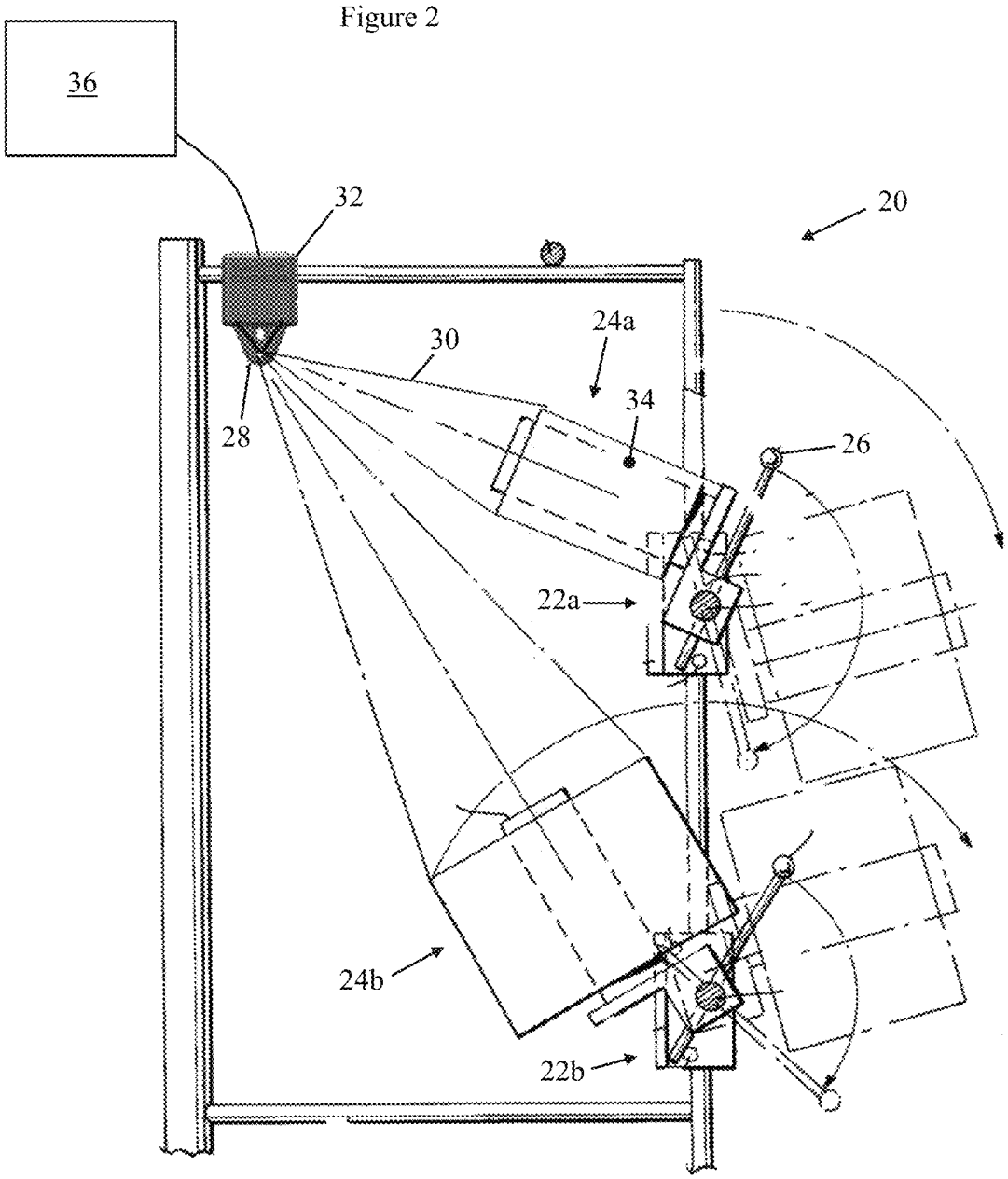
FIG. 2 is a view of part of a creel incorporating a monitoring arrangement embodying the present invention, from above.

FIG. 2 shows only part of a creel 20 comprising a pair of bobbin support arrangements 22*a*, 22*b*. At any given moment in operation, one of the bobbins 24*a* is the active bobbin and one is the reserve bobbin 24*b*. Yarn is drawn from the active bobbin for processing. The yarn is spliced as explained above so that when the active bobbin 24*a* is exhausted, yarn automatically begins to be drawn from the other bobbin 24*b*, which then becomes the active bobbin. This transition from one bobbin to another is referred to herein as "transfer". After transfer the exhausted bobbin 24*a* is replaced and its yarn is spliced to the new active bobbin 24*b*, so that following exhaustion of the new active bobbin 24*b* a further transfer takes place. In this way yarn can be drawn without interruption.

To facilitate replacement of the bobbins 24*a*, 24*b*, the bobbin support arrangements 22*a*, 22*b* are each rotatably mounted, enabling them to turn between an "in-use" position shown in solid lines in the drawing and a "loading" position shown in phantom, and each is provided with a respective handle 26 to assist an operator in moving them between the two positions. With the bobbin support arrangement in the loading position, the operative is able to remove the exhausted bobbin and replace it with a full one, also shown in phantom in the drawing.

In their in-use positions, the bobbin support arrangements 22*a*, 22*b* each support their respective bobbins 24*a*, 24*b* in such an orientation that the bobbins' axes are directed (at least approximately) toward a guide 28 through which the yarn is drawn, which takes the form of an eyelet in the present embodiment.

A free portion 30 of the yarn of the active bobbin 24*a* leads from the bobbin to the guide 28, and as described above it whirls about the bobbin 24*a* forming what is referred to as the balloon by those skilled in the art. The drawing shows the free portion 30 to be straight but in practice it bows outward somewhat to form a curve.

In accordance with the invention, the creel 20 incorporates a sensor module 32 which senses the balloon in order to monitor drawing of yarn from the bobbins 24*a*, 24*b*. In the present embodiment the sensor is optical. Specifically, it responds to light in the visible part of the spectrum. In other embodiments it could in principle respond to electromagnetic radiation in other frequency ranges, e.g. in the ultraviolet or infra-red parts of the spectrum.

In the illustrated embodiment the guide 28 through which the yarn passes to enter the creel's guide structure is incorporated in the sensor module 32, but in other embodiments these may be separately formed.

In the present embodiment the sensor is used in a reflective configuration. A light source (which in this embodiment is incorporated in the sensor module 32, although in other embodiments it may be separate from it) is arranged to emit light in a direction generally away from the sensor module 32 and to illuminate the balloon. Light reflected from the balloon is detectable by the sensor module 32 and is modulated by the revolving motion of the yarn about the bobbin 24*a*. In other embodiments the sensor arrangement may be of transmissive type, using a light source directed toward the sensor module 32 through the balloon, so that the balloon's shadow modulates the light received at the sensor module. A dedicated light source may prove unnecessary.

The sensor provides an output signal which varies periodically due to the modulation provided by the whirling yarn. The sensor signal may of course include some noise, but signal processing techniques familiar to the skilled person can be applied to obtain from the signal a value for the frequency (or equivalently the period) of signal variation, and hence of the frequency (period) of the movement of the free portion 30 of the yarn about the active bobbin 24*a*. In principle the signal processing could for example make use of numerical frequency analysis techniques such as a Fast Fourier Transform, but in practice the computational complexity of such approaches is found to be unnecessary and a simple technique, e.g. involving smoothing the signal and then determining the frequency at which it crosses a threshold value, are found to be adequate for the purpose. This may be referred to as a "zero-crossing" technique, although the signal in this instance does not necessarily fall to zero unless an offset is subtracted from it.

The monitoring arrangement thus provides an output which is a real time indication of the period of the movement of the yarn about the active bobbin 24*a*, which will be referred to below as the "period P". It will be apparent to the skilled person that calculations and other determinations based on the period P could equally well be based on the corresponding frequency.

The period P can in embodiments of the invention used to determine (a) when transfer takes place from one bobbin to another and (b) the approximate quantity of yarn remaining on the bobbin and/or the approximate running time prior to exhaustion of the bobbin.

To appreciate how these determinations are made, note first of all that the free portion of the yarn 30 is drawn from the outermost layer of the body 34 of yarn wound on the bobbin 24*a*. The diameter of this body of yarn reduces as yarn is drawn from it. In FIG. 2, the active bobbin 24*a* is partially depleted and the body of yarn it carries is smaller than that of the full reserve bobbin 24*b*. Typically the linear speed at which yarn is drawn from the bobbin 24*a* is largely constant. Hence as the bobbin is depleted, the rotary speed at which the free portion 30 of the yarn moves about the bobbin 24*a* must progressively increase, and the period P thus decreases. In a real world example, the period P measured for a full bobbin is roughly four times greater than that measured for a bobbin on the point of exhaustion. A mathematical relationship thus exists between the period P and the approximate length of yarn remaining on the bobbin, or equivalently the time remaining to exhaustion of the bobbin. Thus by processing the output signal of the sensor module 32, an indication can be obtained of the approximate time to exhaustion of the active bobbin 24*a* and/or of the length of yarn remaining on it.

The period P is at a minimum immediately prior to transfer from one active bobbin 24*a* to the next, since at that point the diameter of the body 34 of yarn is at its smallest. Upon transfer to the next active bobbin, the period P abruptly changes to a maximum value as yarn begins to be drawn from the full bobbin. This change in the period P is detected and interpreted as an indication of when transfer takes place. Thus the output from the sensor module 32 is processed to provide a real time or almost real time indication of the moment of transfer.

In a practical system each pair of bobbin support arrangements 22*a*, 22*b* on a creel or on a number of creels is typically provided with a respective sensor module 32, outputs from all sensor modules 32 being digitised (e.g. through analogue to digital converters) and transmitted to a computer or computer network schematically represented at 36. The sensor data may be presented to a user through a graphical interface, providing the user with real time data on each bobbin pair. The data logged and presented by such a system may for example include a log of bobbins installed, of transfers between bobbins, and of approximate time to exhaustion of active bobbins. Such data helps to ensure that new bobbins are installed when needed to maintain production, without need of constant manual supervision, but also assists in tracking processing of specific batches of yarn from known sources, which may for example assist in tracing the source of any problems in production back to specific supplies of yarn.

The embodiment described above serves as an example of one possible manner of implementation of the invention, but is non-limiting and numerous variants, changes and modifications are possible without departing from the scope of the present invention according to the appended claims. The illustrated embodiment uses a single sensor module 32 having a single sensor arranged to monitor the balloon of both bobbins 24*a*, 24*b*, whichever is currently active, which is advantageous in terms of simplicity and economy, although the invention could be implemented using a respective sensor for each of the pair of bobbins 24*a*, 24*b*.

The invention claimed is:

1. A method of monitoring drawing of yarn in a creel in which an active bobbin is mounted in the vicinity of a reserve bobbin, the method comprising:

drawing the yarn axially from the active bobbin, so that a free portion of the yarn moves circumferentially about the active bobbin;

continuing to draw the yarn from the active bobbin until the active bobbin is depleted, whereupon a transfer takes place after which the yarn is drawn axially from the reserve bobbin, so that the free portion of the yarn moves circumferentially about the reserve bobbin;

sensing the free portion of the yarn using at least one sensor responsive to electromagnetic radiation to provide a sensor output which varies with a period P corresponding to the period of the circumferential movement of the free portion of the yarn;

detecting a change in the period P that takes place upon said transfer, and thereby detecting occurrence of said transfer.

2. A method as claimed in claim 1 comprising responding to said change in period P by providing an output for a user indicating that transfer has taken place.

3. A method as claimed in claim 1 further comprising estimating either or both of (a) time to exhaustion of the active bobbin and (b) quantity of yarn remaining on the active bobbin based on the period P.

4. A method as claimed in claim 1 in which the sensor is an optical sensor.

5. A method as claimed in claim 4 comprising illuminating the free portion of the yarn with a light source detection of light reflected from the free portion of the yarn using the sensor.

6. A system for monitoring drawing of yarn in a creel in which an active bobbin is mounted in the vicinity of a reserve bobbin, and in which yarn is drawn axially from the active bobbin so that a free portion of the yarn moves circumferentially about the bobbin until the active bobbin is depleted, whereupon a transfer takes place after which the yarn is drawn axially from the reserve bobbin so that the free portion of the yarn moves circumferentially about the reserve bobbin, the system comprising:

at least one sensor responsive to electromagnetic radiation mountable in the vicinity of the active and reserve bobbins to sense the free portion of the yarn and to provide an output which varies with a period P corresponding to the period of the circumferential movement of the free portion of the yarn; and a processing device configured to determine the period P from the output of the sensor, to detect a change in the period P indicative of said transfer, and to log a transfer event in response.

7. A system as claimed in claim 6 in which the processing device is configured to estimate either or both of (a) time to exhaustion of the bobbin and (b) quantity of yarn remaining on the bobbin based on the period P.

8. A system as claimed in claim 6 in which the sensor is an optical sensor.

9. A system as claimed in claim 8 further comprising a light source for illuminating the free portion of the yarn, the sensor being configured to detect light reflected from the free portion of the yarn.

10. A creel provided with a system as claimed in claim 6.

11. A creel as claimed in claim 10 in which a single sensor is configured to monitor yarn drawn from both the active bobbin and the reserve bobbin.

* * * * *